US010791390B2

(12) United States Patent
Karayiannis et al.

(10) Patent No.: US 10,791,390 B2
(45) Date of Patent: Sep. 29, 2020

(54) FLEX-FIT EAR TIP FOR HEADPHONES

(71) Applicant: Harman International Industries, Incorporated, Stamford, CT (US)

(72) Inventors: Effrosini A. Karayiannis, Manchester, MO (US); Kim Hyo Jin, Stamford, CT (US); Derek Campbell, Stamford, CT (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/258,055

(22) Filed: Jan. 25, 2019

(65) Prior Publication Data

US 2020/0245049 A1 Jul. 30, 2020

(51) Int. Cl.
*H04R 1/10* (2006.01)

(52) U.S. Cl.
CPC ..... *H04R 1/105* (2013.01); *H04R 1/1016* (2013.01); *H04R 1/1041* (2013.01)

(58) Field of Classification Search
CPC ..... H04R 2225/023; H04R 2225/025; H04R 2460/13; H04R 1/1016
USPC ..... 381/328, 380
See application file for complete search history.

(56) References Cited

U.S. PATENT DOCUMENTS 5,953,435 A 9/1999 Mullin et al.
8,036,853 B2 10/2011 Jayanth et al.
8,254,624 B2 8/2012 Silvestri et al.
8,311,253 B2 11/2012 Silvestri et al.
8,737,669 B2 5/2014 Monahan et al.
8,761,424 B2 * 6/2014 Wubker ..... H04R 25/654 381/380
8,897,480 B2 * 11/2014 Tan ..... H04R 1/105 381/380
8,929,582 B2 1/2015 Silvestri et al.
8,989,426 B2 3/2015 Silvestri et al.
9,036,852 B2 5/2015 Silvestri et al.
9,042,590 B2 5/2015 Silvestri et al.
9,398,364 B2 7/2016 Monahan et al.
(Continued)

FOREIGN PATENT DOCUMENTS

CN 101562764 A 10/2009
EP 3128761 A1 2/2017

OTHER PUBLICATIONS

A screen capture from YouTube video clip entitled "groov-eAction GVBT800 Wireless Sports Earphones with LED Neckband", uploaded on Jul. 20, 2017 by groov-e, https://www.youtube.com/watch?v=2h3ITbu7430, 2017, 1 page.

*Primary Examiner* — Suhan Ni
(74) *Attorney, Agent, or Firm* — Brooks Kushman P.C.

(57) ABSTRACT

In at least one embodiment, a headphone apparatus including an earbud is provided. The earbud includes a housing, a flexible skirt, and a flexible tip portion. The housing includes a loudspeaker positioned therein and at least a portion of the housing being arranged to be received in a user's concha. The flexible skirt is removably coupled to at least a portion of the housing to be at least partially received in an ear canal of the user. The flexible tip portion extends from the housing and the flexible tip portion is configured to be received in at least an antihelix of the user. The flexible tip portion includes an outer wall and a rib intersecting with the outer wall such that the outer wall applies a force against the rib in response to contact with an anti-helical fold of the user's ear.

18 Claims, 3 Drawing Sheets

(56) References Cited

U.S. PATENT DOCUMENTS

| | | | | |
|---|---|---|---|---|
| 9,723,395 | B2 | 8/2017 | Kim | |
| D835,077 | S | 12/2018 | Aoyagi et al. | |
| D881,163 | S | 4/2020 | Duddy et al. | |
| 2009/0147981 | A1 | 6/2009 | Blanchard et al. | |
| 2009/0274335 | A1 | 11/2009 | Cheung et al. | |
| 2010/0041447 | A1 | 2/2010 | Graylin | |
| 2012/0039501 | A1 | 2/2012 | Silvestri et al. | |
| 2013/0058517 | A1 | 3/2013 | Lee et al. | |
| 2013/0256345 | A1 | 10/2013 | Larkin | |
| 2014/0119589 | A1 | 5/2014 | Wyzisk et al. | |
| 2015/0030194 | A1 | 1/2015 | Burgett et al. | |
| 2015/0139474 | A1 | 5/2015 | Henry et al. | |
| 2015/0156579 | A1 | 6/2015 | Lowry | |
| 2015/0351688 | A1 | 12/2015 | Just et al. | |
| 2016/0066079 | A1 | 3/2016 | Kolton | |
| 2016/0073192 | A1* | 3/2016 | Briggs | H04R 1/1058 381/380 |
| 2016/0269817 | A1 | 9/2016 | Basseas et al. | |
| 2016/0366506 | A1 | 12/2016 | Kim | |
| 2016/0381453 | A1 | 12/2016 | Ushakov | |
| 2017/0070801 | A1 | 3/2017 | Nguyen et al. | |
| 2017/0339481 | A1 | 11/2017 | Laberge | |
| 2018/0220725 | A1 | 8/2018 | Graylin | |
| 2018/0242068 | A1 | 8/2018 | Kelley et al. | |
| 2019/0069064 | A1 | 2/2019 | Ott et al. | |

* cited by examiner

FLEX-FIT EAR TIP FOR HEADPHONES

TECHNICAL FIELD

Aspects disclosed herein generally relate to a headphone apparatus including an earbud that plays back audio data for a user. These aspects and other will be discussed in more detail below.

BACKGROUND

U.S. Publication No. 2017/0339481 to Laberge discloses an earpiece system comprising an enhancer. The enhancer is configured to receive an earbud of a speaker and to fit in a user's ear. The enhancer includes a first portion having a first surface that defines a concave crus relief feature. The enhancer further includes a second portion extending from the first portion and forming a sound tunnel having an opening at an end opposite the first portion, and a flexible skirt positioned with the sound tunnel and projecting over the second portion to resiliently seal with the user's ear canal when inserted therein.

U.S. Publication No. 2015/0030194 to Burgett et al. provides, among other things, an earbud adapter or in-ear monitor that includes an ear interface that fits the human ear and further permits the wearer of these devices to adjust parameters of the fit. In additional aspects, the ear interface portion of these devices permits the user to adjust the transmission of ambient sound. The ear interface portion also allows the user to change ornamentation.

SUMMARY

In at least one embodiment, a headphone apparatus including an earbud is provided. The earbud includes a housing, a flexible skirt, and a flexible tip portion. The housing includes a loudspeaker positioned therein and at least a portion of the housing being arranged to be received in a user's concha. The flexible skirt is removably coupled to at least a portion of the housing to be at least partially received in an ear canal of the user. The flexible tip portion extends from the housing. The flexible tip portion is configured to be received in at least an antihelix of the user. The flexible tip portion includes an outer wall and a rib intersecting with the outer wall such that the outer wall applies a force against the rib in response to contact with an anti-helical fold of the user's ear.

In at least another embodiment, a headphone apparatus including an earbud is provided. The earbud includes a housing, a flexible skirt, and a flexible tip portion. The housing includes a loudspeaker positioned therein and at least a portion of the housing is arranged to be received in a user's concha. The flexible skirt is removably coupled to at least a portion of the housing to be at least partially received in an ear canal of the user. The flexible tip portion extends from the housing. The flexible tip potion is configured to be received in at least an antihelix of the user. The flexible tip portion includes an outer wall and a rib intersecting with the outer wall such that the outer wall applies a force against the rib in response to contact from an anti-helical fold of user's ear.

In at least another embodiment, a headphone apparatus including an earbud is provided. The earbud includes a housing, a flexible skirt, and a flexible tip portion. The housing includes a loudspeaker positioned therein and at least a portion of the housing is arranged to be received in a user's concha. The flexible skirt being is removably coupled to at least a portion of the housing to be at least partially received in an ear canal of the user. The flexible tip portion extends from the housing. The flexible tip potion is configured to be received in at least an antihelix of the user. The flexible tip portion includes an outer wall and a plurality of ribs being spaced apart from one another. The outer wall is configured to apply a force against the plurality of ribs in response to contact with in response to contact with a corresponding anatomical feature of the user's ear.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompanying drawings in which:

DETAILED DESCRIPTION

Figure 1:
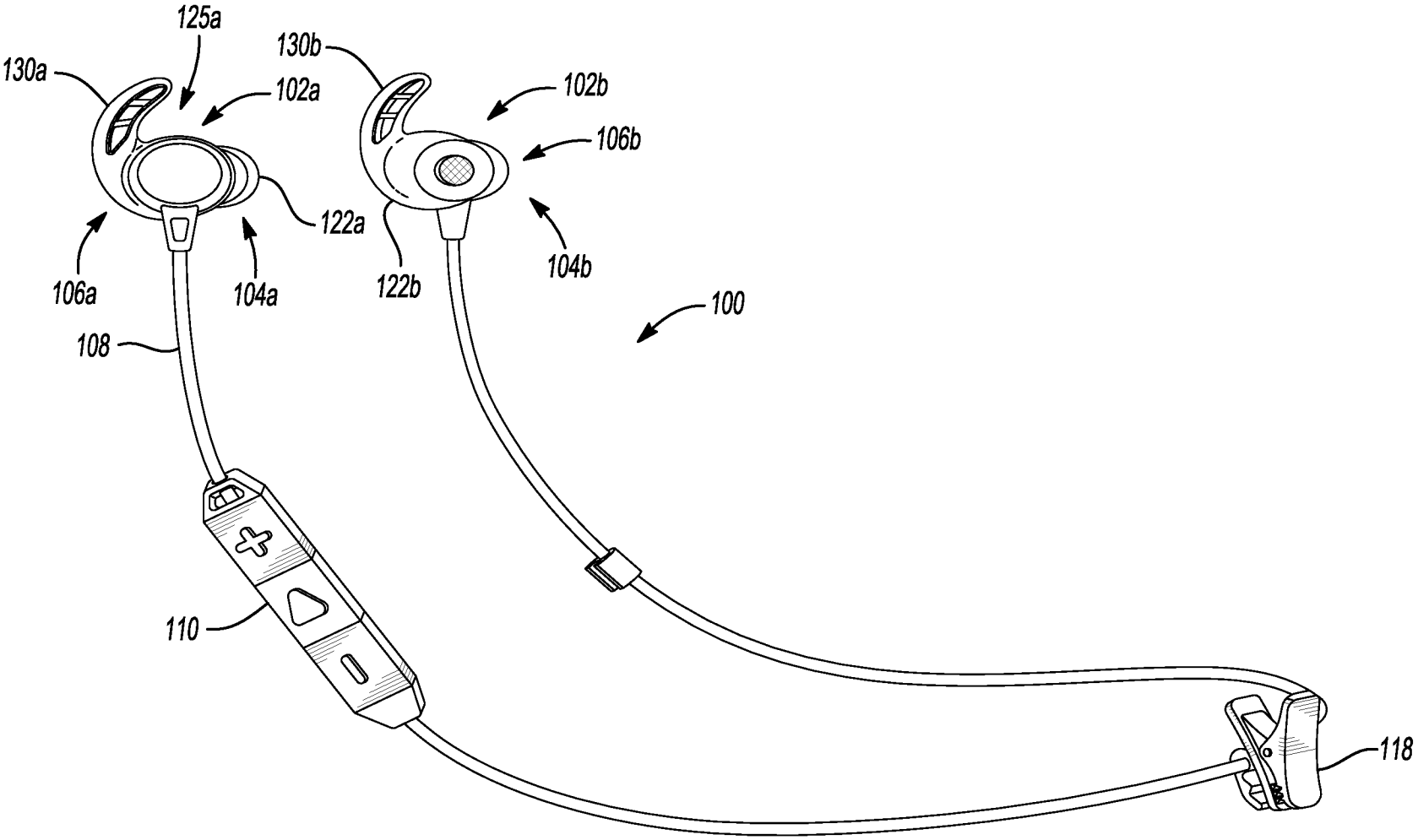
FIG. 1 depicts a view of a headphone apparatus in accordance to one embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Aspects disclosed herein generally provide for a headphone apparatus that includes earbuds (or in-ear headphones) with each earbud being at least partially inserted into a corresponding ear canal of a user. Each earbud provides an audio signal into the ear canal of the user. The earbud generally includes an enhancer that is positioned over a main body section of a housing. The main body section may be formed of hard plastic. The enhancer may be formed of silicon and and provides comfort for the user when the earbud is inserted into the ear. For example, the enhancer may fit into a concha of the user's ear. In some cases, the enhancer may not fit properly into the concha of the ear for the user, particularly with respect to an upper portion of the concha.

The disclosed earbud includes a flex-fit ear tip portion (or "flex tip portion") that is integrated with the enhancer. The ear tip portion is generally positioned within the upper portion of the concha and into an antihelix of the user's ear. The ear tip portion includes perforated vents (or compression openings) that are separated by ribs. The venting (or openings) on the flex tip portion is directional and angular for improved compression when the ear tip portion is inserted into the upper portion of the concha and into the antihelix of the user's ear. The shape of the vents is angled in a direction parallel to the flex tip portion itself, so that the flex-tip portion may compress freely and allow the flex tip portion (or wing) to adapt to the size of the user's antihelix. This adaption of the size of the flex tip portion may provide for a semi-custom fit for the user and may further alleviate pressure that would otherwise be felt in an underside of an anti-helix (or anti-helical fold) of the ear. This aspect generally provides some degree of pain if such an adaptation of the size of the flex tip portion was not permitted. In light of the foregoing, the headphone apparatus and associated earbuds provided herein may, among other things, provide a stable fit of the earbud into the user's ear during workouts performed by the user, relieve pain for earbuds that provide an ear tip portion that does not properly fit within the anti-helix, and/or create a recognizable visual cue of sport and comfort that may be associated with a particular brand of the headphone apparatus over time. These aspects and others will be discussed in more detail below.

FIG. 1 depicts a view of a headphone apparatus (or headphones) 100 in accordance to one embodiment. The headphone 100 generally includes earphones (or earbuds) 102*a*-102*b* (or "102"). The earbuds 102*a*, 102*b* generally include housings 104*a*, 104*b* (or "104"), respectively. The housing 104 may be constructed of plastic, steel, etc. A mobile device (not shown) or other media playback device (not shown) may transmit audio data to the apparatus 100 to playback audio data for the user. The earbuds 102*a* and 102*b* include transducers 106*a*, 106*b*, respectively, to playback audio data for the user. In another example, the headphones 100 may include memory (not shown) positioned in at least one of the housings 104 to store the audio data and to playback the same for the user as opposed to the mobile device providing the audio data for the headphones 100. It is recognized that the headphones 100 may not be used exclusively for audio playback. For example, the headphones 100 may also include a microphone (not shown) to receive an audio input from the user. The headphones 100 may in turn transmit the audio input to a mobile device, speaker phone (or bridge) for teleconferences, etc. or other suitable device used in connection with the transmission of audio data from the headphones 100.

In addition, the headphones 100 may be used as bionic headphones. In this case, one or more microphones (not shown) positioned within the headphones 100 may capture ambient audio external to the headphones 100. When a predetermined ambient audio signal is captured by the headphones 100, the headphones 100 may mute the audio that is being played back or reduce the volume level of the audio that is being played back (i.e., auto adjust noise level down when ambient noises occur) to enable the user to hear the predetermined ambient audio signal. In this example, the headphones 100 may be considered to provide super-sonic hearing that enables the user to listen to ambient noise when listening to music under any number of usage profiles.

In one embodiment, a flexible coated wire 108 is attached to each end of the housings 104*a*, 104*b*. The coated wire 108 generally includes electrical wiring to facilitate electrical communication between the electronics (not shown) positioned within each housing 104*a* and 104B. A switch 110 is positioned between the housing 104*a* and 104*b* and is configured to adjust a volume level for the audio that is played back to the user via the headphones 100. It is recognized that the switch 110 may provide other functionality such as pairing operations between the headphones 100 and the mobile device (not shown), power on/off, etc. A clip 118 may be positioned on the flexible coated wire 108 so that the user can attached the headphones 100 to clothing or other suitable device to prevent the headphones 100 from being lost or misplaced.

In another embodiment, the headphones 100 may not require the coated wire 108 and each corresponding earbud 102*a*, 102*b* may wireless receive audio data from an audio source and provide the same to the user. In this case, the switch 110 may be positioned directly on one or more the earbuds 102*a*, 102*b* to control functions of the headphones 100 (e.g., adjust volume, mute, answer phone call, etc.). A separate controller may not be required for the wireless based earbud implementation.

The earbuds 102*a*, 102*b* generally include a flexible skirt 122*a*, 122*b* (or "122"), respectively, and an enhancer 125*a*, 125*b* (or "125"), respectively. The enhancer 125 may be removably coupled to a main body section (not shown) of the housing 104. The housing 104 includes a sound tunnel (not shown) that defines an audio channel for providing audio to the user from the transducer 106. The flexible skirt 122 is removably coupled to the sound tunnel. The flexible skirt 122 may take on any number of shapes and sizes. The flexible skirt 122 is at least partially inserted into an ear canal of a user to provide the audio data. The enhancer 125 is generally positioned within the concha of a user' ear to provide comfort for the user. The enhancer 125 may be formed of silicone or other suitable material.

Each enhancer 125*a*, 125*b* generally includes a flexible tip portion (or flex-tip portion) 126*a*, 126*b* (or "126"), respectively. The flex-tip portion 126 may be integrated with the enhancer 125 and may also be formed of silicone. The flex-tip portion 126 may be positioned within the cymba of the concha and the antihelix of the ear. The flex-tip portion 126 is generally configured to compress within a cymba of the concha and antihelix of the ear to alleviate pressure that would otherwise be felt in an underside of an anti-helical fold of the ear when the earbuds 102*a*, 102*b* are inserted into a corresponding ear canal of the use. These aspects will be discussed in more detail below.

Figure 2:
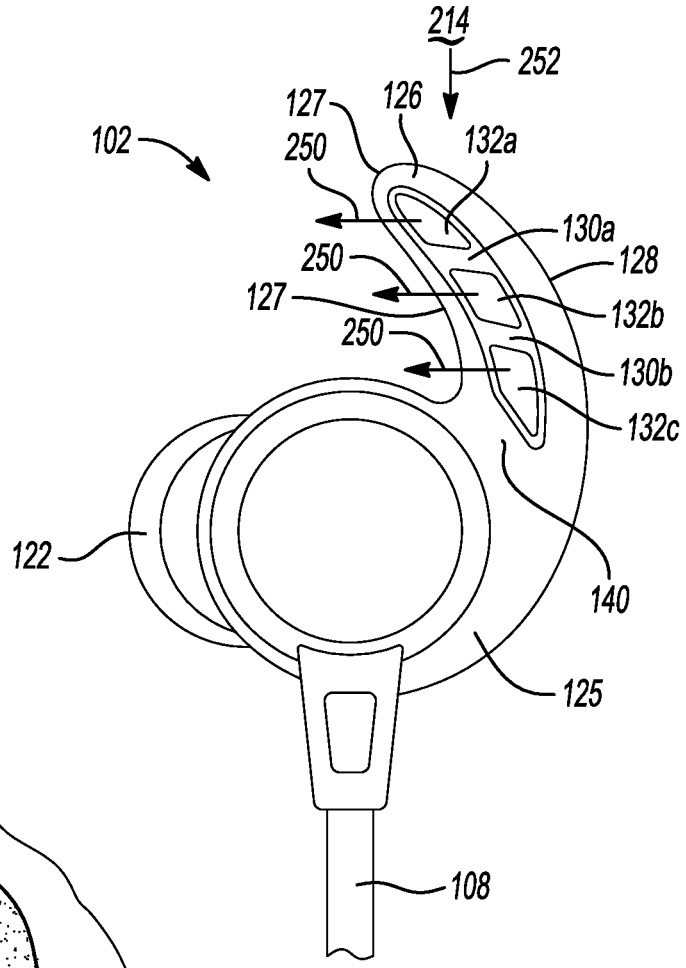
FIG. 2 depicts a detailed view of a flex tip portion of an earbud of the headphone apparatus in accordance to one embodiment.

FIG. 2 depicts a detailed view of the flex tip portion 126 of the enhancer 125 of the headphone apparatus 100 in accordance to one embodiment. The flex tip portion 126 may be arcuately shaped to fit within the antihelix of the ear. The flex tip portion 126 generally includes an interior wall 127 formed on an interior portion thereof and an outer wall 128 formed on an exterior portion thereof. The inner wall 127 is generally oriented or positioned closest to a front face of the user. The outer wall 128 is generally orientated or positioned closest to a back of the head of the user. The interior wall 127 and the outer wall 128 are integrated with one another at a top section 129 of the flex tip portion 126. The flex tip portion 126 generally includes a plurality of flexible ribs 130*a*-130*b* that are spaced apart from one another. Each of the ribs 130*a* and 130*b* extend about an axis to intersect the outer wall 128 and the inner wall 127. The ribs 130*a* and 130*b* may or may not be parallel with one another. The inner wall 127, the outer wall 128, and the ribs 130*a* and 130*b* are integrally formed with one another. Each of the ribs 130*a* and 130*b* extend about an axis to intersect with the inner wall 127 and the outer wall 128. In addition, each rib 130*a* and 130*b* and corresponding sections of the inner wall 127 and the outer wall 128 define corresponding compression chambers (or compression openings) 132*a* and 132*b*, respectively. An upper portion 140 of the enhancer 125, the rib 130*b*, a corresponding section of the inner wall 127, and a corresponding section of the outer wall 128 define a compression opening 132*c*. In general, upon insertion of the earbud 102 into the ear, an anti-helical fold of the ear may apply a force on the outer wall 128 thereby forcing the outer wall 128, the inner wall 127, the ribs 130*a*, 130*b* and the compression openings 132*a*, 132*b*, and 132*c* to move in a generally horizontal direction to enable the flex tip portion 126 to compress into the concha and into the antihelix of the ear. This aspect generally enables the flex tip portion 126 to remain securely and comfortably positioned within the concha and the antihelix of the ear.

Figure 3:
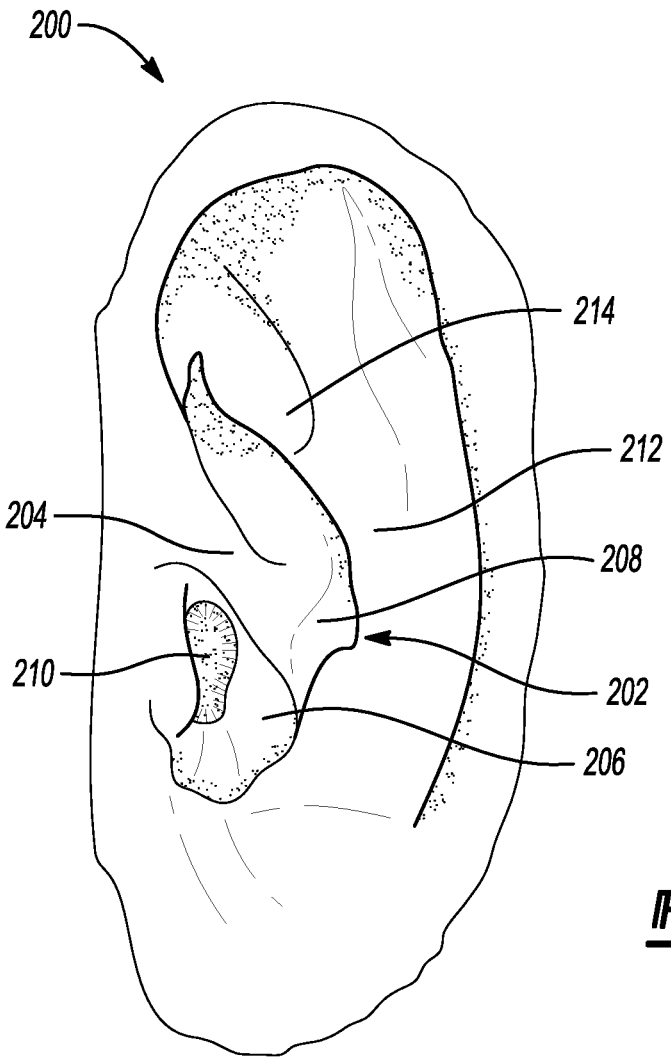
FIG. 3 depicts a view of a left human ear and corresponding anatomical parts.

FIG. 3 generally illustrates anatomical features of the human ear 200 and is set forth to provide a reference to illustrate the manner in which the flex tip portion 126 is positioned within the ear 200 of the user. The ear 200 includes a concha 202 and a crus helix 204. The concha 202 generally includes a cavum 206 and a cymba 208. The crus helix 204 generally separates the cymba 208 from the cavum 206. An ear canal 210 is positioned proximate to the cavum 206. The ear 200 further includes an antihelix 212 and anti-helical fold 214. The antihelix 212 at least partially surrounds the cavum 206 which is recessed into the ear 200. As the earbud 102 is inserted the ear 200, the flexible skirt 122 of the earbud 102 is generally positioned (or inserted) within the ear canal 210 and the enhancer 125 may be positioned within the cavum 206 of the concha 202. The enhancer 125 may be at least partially positioned over the crus helix 204 and/or over a lower portion of the cymba 208. The flex tip portion 126 may be positioned over (or within) the cymba 202 and at least partially within a boundary of the antihelix 212. The flex tip portion 126 is generally configured to flex (or compress) under the anti-helical fold 214 of the ear 200.

In reference back to FIG. 2, the flex tip portion 126 is generally configured to compress or flex generally along a first axis 250 (e.g., horizontal axis) as the anti-helical fold 214 applies a generally vertical (or generally downward) force 252 against one or more sections of the outer wall 128. The outer wall 128 may apply a force against the plurality of ribs 130*a* and 130*b* in response to contact from the anti-helical fold 214. Alternatively, the anti-helical fold 214 may compress the outer wall 128 in a generally downward manner which in turn causes the outer wall 128, the inner wall 127, the ribs 130*a*-130*b* to move along the first axis 250 to compress into the cymba 208 (i.e., the concha) and within the antihelix 214. It is recognized that the anatomical features of the ear 200 vary from user to user and the amount of force as applied by anti-helical fold 214 will vary based on the user's corresponding ear anatomy. The movement of the flex tip portion 126 about the first axis 250 enables the flex tip portion 126 to securely attach to the user's ear 200 and prevents any pain and discomfort due to the force or compression applied from the antihelical fold 214. The ribs 130*a*-130*b* may provide a counter force against the outer wall 128 to provide stability to ensure that the flex tip portion 126 remains securely attached to the concha 202 and to the antihelix 212 of the ear 200. In addition, the compression openings 132*a*-132*c* enable adequate compression of the outer wall 128 in response to the force applied by the anti-helical fold 214 to prevent pain and discomfort for the user.

Figure 4:
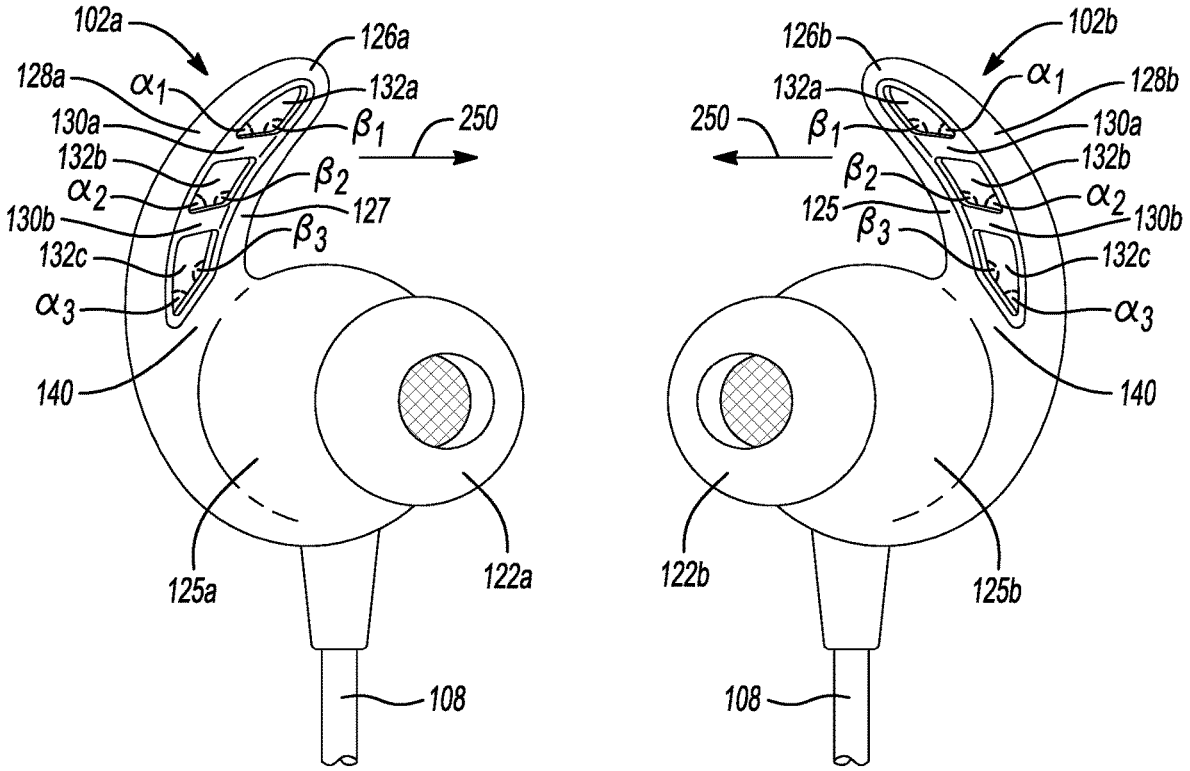
FIG. 4 depicts a rear view of the flex tip portion of the earbuds of the headphone apparatus in accordance to one embodiment.

FIG. 4 depicts a rear view of the flex tip portions 126*a* and 126*b* for the corresponding earbuds 102*a* and 102*b*, respectively, of the headphones 100. Each compression opening 130*a*, 130*b*, and 130*c* forms an angle $\alpha_1$, $\alpha_2$, and $\alpha_3$ at a lower portion thereof that is generally less than 90 degrees. Such a formation enables the flex tip portion 126 (e.g., the outer wall 128) to compress at least partially along the first axis 250. Likewise, each compression opening 130*a*, 130*b*, and 130*c* forms an angle $\beta_1$, angle $\beta_2$, and angle $\beta_3$ at an opposite portion of the lower portion that is generally greater than 90 degrees to enable the flex tip portion 126 (e.g., the inner wall 127) to compress along the first axis 250. In general, the overall length for any corresponding compression opening 132*a*, 132*b*, and 132*c* may be, for example, within a range of 1.8 to 3.0 mm. The overall width of the outer wall 128 may be, for example, within a range of 2.0 to 3.3 mm and the overall width of the inner wall 127 may be, for example, within a range of 0.6 to 1.5 mm. An overall thickness for any one of the ribs 130*a* and 130*b* may be within a range of 0.8 to 1.5 mm. Such dimensions may enable the flex tip portion 126 to provide an adequate level of compression when positioned within the ear 200 and further enable the flex tip portion 126 to be securely attached to the ear 200 and provide comfort for the user.

Figure 5:
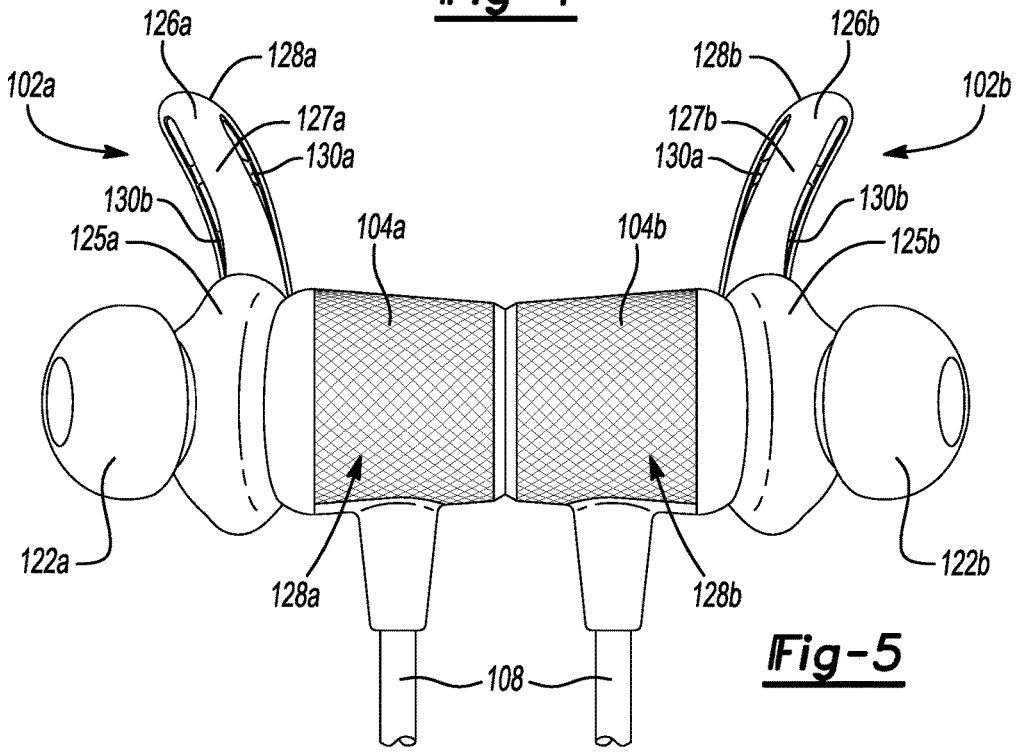
FIG. 5 depicts a side view of the earbuds of the headphone apparatus in accordance to one embodiment.

FIG. 5 depicts a side view of the earbuds 102*a*, 102*b* of the headphones 100 in accordance to one embodiment. As shown, an overall thickness of the ribs 130*a*, 130*b* may be less than the overall thickness of the outer wall 128. This aspect further aids in the compression of the outer wall 128 under the force applied by the from the antihelical fold 214. In addition, the overall thickness of the ribs 130*a*, 130*b* may be greater than the overall thickness of the inner wall 127. These aspects may also enable the flexible tip portion 126 to move or compress against the force applied from the anti-helical fold 214 and may also enable the flexible tip portion 126 to remain securely attached to the ear 200 of the user.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A headphone apparatus comprising:

an earbud including:

a housing including a loudspeaker positioned therein, at least a portion of the housing being arranged to be received in a user's concha;

a flexible skirt being removably coupled to at least a portion of the housing to be at least partially received in an ear canal of the user; and an enhancer removably coupled to the housing, the enhancer including a flexible tip portion extending from an upper portion of the enhancer, the flexible tip portion being configured to be received in at least an antihelix of the user, the flexible tip portion including an outer wall, an inner wall positioned opposite to the outer wall and a transverse rib intersecting with the outer wall and the inner wall, such that the outer wall applies a force against the rib in response to contact with an anti-helical fold of the user's ear.

2. The headphone apparatus of claim 1, wherein a thickness of the outer wall is greater than a thickness of the rib.

3. The headphone apparatus of claim 1, wherein a thickness of the rib is greater than a thickness of the inner wall.

4. The headphone apparatus of claim 1, wherein the outer wall, the inner wall, and the rib are integrally formed with one another.

5. The headphone apparatus of claim 1, wherein a first portion of the outer wall, a first portion of the inner wall, and the rib define a compression opening to enable the outer wall to compress into the compression opening along an axis in response to contact with the anti-helical fold of the user's ear.

6. The headphone apparatus of claim 5, wherein the compression opening forms a first angle that is less than 90 degrees at a first portion thereof.

7. The headphone apparatus of claim 6, wherein the compression opening forms a second angle that is greater than 90 degrees at a second portion thereof, the second portion being positioned opposite to the first portion.

8. The headphone apparatus of claim 1, wherein the flexible tip portion is arcuately shaped to fit within the antihelix of the ear.

9. The headphone apparatus of claim 1, wherein flexible tip moves at least partially along a generally horizontal axis in response to contact with the anti-helical fold.

10. A headphone apparatus comprising:

an earbud including:

a housing including a loudspeaker positioned therein, at least a portion of the housing being arranged to be received in a user's concha;

a flexible skirt being removably coupled to at least a portion of the housing to be at least partially received in an ear canal of the user; and an enhancer removably coupled to the housing, the enhancer including a flexible tip portion extending from an upper portion of the enhancer, the flexible tip portion being configured to be received in at least an antihelix of the user, the flexible tip portion including an outer wall, an inner wall positioned opposite to the outer wall, and a plurality of transverse ribs being spaced apart from one another and intersecting the outer wall and the inner wall, the outer wall being configured to apply a force against the plurality of ribs in response to contact with a corresponding anatomical feature of the user's ear.

11. The headphone apparatus of claim 10, wherein a thickness of the outer wall is greater than a thickness of each of the plurality of ribs.

12. The headphone apparatus of claim 10, wherein a thickness of each of the plurality of ribs is greater than a thickness of the inner wall.

13. The headphone apparatus of claim 10, wherein the outer wall, the inner wall, and the plurality of ribs are integrally formed with one another.

14. The headphone apparatus of claim 10, wherein a first portion of the outer wall, a first portion of the inner wall, and one of the plurality of ribs define a compression opening to enable the outer wall to compress into the compression opening along an axis in response to contact with the anti-helical fold of the user's ear.

15. The headphone apparatus of claim 14, wherein the compression opening forms a first angle that is less than 90 degrees at a first portion thereof.

16. The headphone apparatus of claim 15, wherein the compression opening forms a second angle that is greater than 90 degrees at a second portion thereof, the second portion being positioned opposite to the first portion.

17. The headphone apparatus of claim 10, wherein the flexible tip portion is arcuately shaped to fit within the antihelix of the ear.

18. The headphone apparatus of claim 10, wherein flexible tip moves at least partially along a generally horizontal axis in response to contact with the anti-helical fold.

* * * * *